US005088793A

United States Patent [19]

Mithuhiro

[11] Patent Number: 5,088,793

[45] Date of Patent: Feb. 18, 1992

[54] CUSHION CONSTRUCTION FOR SEAT

[75] Inventor: Kazuso Mithuhiro, Hiroshima, Japan

[73] Assignee: Delta Kogyo Co., Ltd., Hiroshima, Japan

[21] Appl. No.: 642,542

[22] Filed: Jan. 17, 1991

Related U.S. Application Data

[63] Continuation of Ser. No. 397,653, Aug. 23, 1989, abandoned.

[30] Foreign Application Priority Data

Aug. 23, 1988 [JP] Japan ..... 63-110559
Aug. 23, 1988 [JP] Japan ..... 63-110560
Aug. 23, 1988 [JP] Japan ..... 63-110561

[51] Int. Cl.[5] ..... A47C 7/02
[52] U.S. Cl. ..... 297/452; 297/459
[58] Field of Search ..... 297/452, 459, 460

[56] References Cited

U.S. PATENT DOCUMENTS 3,411,824 11/1968 White et al. ..... 297/452
3,497,883 3/1970 Arnold et al. ..... 297/452 X
3,797,886 3/1974 Griffiths ..... 297/452
3,880,467 4/1975 Tischler ..... 297/452
4,191,424 3/1990 Mundell ..... 297/459
4,283,046 8/1981 Bowles, Jr. ..... 297/452 X
4,289,304 9/1981 Muzzell ..... 297/452 X
4,337,931 7/1982 Mundell et al. ..... 297/452 X
4,784,437 11/1988 Shimada ..... 297/452

*Primary Examiner*—Jose V. Chen
*Attorney, Agent, or Firm*—Wenderoth, Lind & Ponack

[57] ABSTRACT

A seat cushion construction wherein the mesh frame is pulled downwardly by tension members disposed between a projecting portion of the cushion frame and the frame wire of the mesh frame, so that the tension springs supporting the mesh frame are adapted to be retained in a condition where they are stretched obliquely downwardly, so that the mesh frame is lowered even if the cushion frame is not lowered, so that the thickness of the cushion pad can be increased, thus improving the cushioning property.

6 Claims, 10 Drawing Sheets

CUSHION CONSTRUCTION FOR SEAT

This application is a continuation of Ser. No. 397,653, filed on Aug. 23, 1989, now abandoned.

BACKGROUND OF THE INVENTION

The present invention generally relates to improvements in the cushion construction for a seat.

Generally, it is proposed as the conventional seat cushion construction that a mesh frame 3 be disposed within a central opening 2 of the cushion frame 1 as shown in FIG. 19, the mesh frame 3 be stretched, supported with many tension springs 4 engaged with the cushion frame 1, and also a cushion pad 5 be placed on the mesh frame 3 and the cushion frame 1 as shown in FIG. 20, with the surface of the cushion pad 5 being covered with a trim 6*a*.

When a slide screw 6 for seat sliding, a slide nut 7, and so on are provided under the seat frame 1, the tension springs 4 and so on may come into contact against them, so that the mesh frame 3 cannot be lowered downwardly. Accordingly, the thickness t' of the cushion pad 5 is made thin, thus causing the cushioning property to be poor.

Also, there is another problem in that when no one is seated on the cushion, only a force sufficient to support the mesh frame 3 works on the tension springs 4. As the elastic force starts to increase due to the load of the sitter, the initial deflection of the cushion is good. But the deflection amount decreases as the load becomes larger. A so-called bottom-touching feeling is produced which causes a bad feeling to the person sitting on the cushion.

SUMMARY OF THE INVENTION

Accordingly an object of the present invention is to provide a cushion construction of a seat which is superior in cushioning properties and the feeling.

In accomplishing this object, according to the embodiment of the present invention, there is provided a seat cushion construction, wherein a mesh frame is disposed within the central opening of the cushion frame, the mesh frame is stretched, supported by the tension springs engaged with the cushion frame, and a cushion pad is placed on the mesh frame and the cushion frame, the surface of the cushion is covered with a trim, and which is characterized in that a projecting portion which extends downwardly to extend under the frame wire of the mesh frame is formed on the peripheral edge of the central opening of the cushion frame, a tension member is provided which pulls the mesh frame downwardly to retain the tension spring in a condition where the tension spring is obliquely stretched downwardly between the projecting portion and the frame wire of the mesh frame. The mesh frame is pulled downwardly by a tension member disposed between the projecting portion of the cushion frame and the frame wire of the mesh frame so as to retain the tension spring in a condition where the tension spring is obliquely stretched downwardly.

Accordingly, the mesh frame may be lowered after the tension spring has been made oblique even if the cushion frame is not lowered, so that the thickness of the cushion pad may be increased, thus improving the cushioning property.

Also, as the elastic force (tensile force) works in advance upon the tension spring in cooperation with the increased thickness of the cushion pad, the initial deflection of the cushion is good and also, as the tension spring works in accordance with the increasing load, the deflection may be sufficiently felt, and the bottom-touching feeling is avoided so as to improve the feeling.

Furthermore, during the setting up operation, as the tension spring has only to be engaged between the cushion frame and the mesh frame with an elastic force sufficient to stretch and support the mesh frame, the grabbing property of the tension spring is good, and also the tension member has only to be engaged between the projecting portion of the cushion frame and the frame wire of the mesh frame with the mesh frame being controlled from above, improving the grabbing property of the tension member.

Also, according to the present invention, there is provided a seat cushion construction, wherein a mesh frame is disposed within the central opening of the cushion frame, the mesh frame is stretched, supported by tension spring engaged with the cushion frame, and also a cushion pad is placed on the mesh frame and the cushion frame, the surface of the cushion is covered with a trim, and which is characterized in that a projecting portion which extends downwardly onto the side of the frame wire of the mesh frame is formed on the peripheral edge of the central opening of the cushion frame, and the frame wire of the mesh frame is abutted against the projecting portion in a condition where the frame wire of the mesh frame is pulled downwardly, the tension spring is retained in a condition where the tension spring is obliquely downwardly stretched.

Accordingly, in this embodiment also, the mesh frame may be lowered after the tension spring has been made oblique if the cushion frame is not lowered, so that the thickness of the cushion pad may be increased, thus improving the cushioning property.

Also in this embodiment, as the elastic force (tensile force) works in advance upon the tension spring in cooperation with the increased thickness of the cushion pad, the initial tension of the cushion is good, and also the tension spring works in accordance with the increasing load, so that the deflection may be sufficiently felt, the bottom-touching feeling is avoided, thus providing better feeling.

Furthermore, according to the present invention there is provided a seat cushion construction, wherein a mesh frame is disposed within the central opening of the cushion frame, the mesh frame is stretched, supported by tension springs engaged with the cushion frame, and also a cushion pad is placed on the mesh frame and the cushion frame, the surface of the cushion is covered with a trim, and which is characterized in that a projecting portion which extends downwardly is formed on the peripheral edge of the central opening of the cushion frame, a projecting portion formed on the frame wire of the mesh frame is abutted against the projecting portion which extends downwardly, the tension spring is retained in a condition where the tension spring is downwardly stretched obliquely. The present invention is adapted to abut the projecting portion of the frame wire of the mesh frame against the projecting portion of the cushion frame, and downwardly pull the mesh frame to retain the tension spring in a condition where the tension spring is obliquely stretched downwardly.

Accordingly, the mesh frame may be lowered after the tension spring has been made oblique even if the cushion frame is not lowered, so that the thickness of the cushion pad may be increased, thus improving the cushioning property.

Also, as the elastic force (tensile force) works in advance upon the tension spring in cooperation with the increased thickness of the cushion pad, the initial deflection of the cushion is good, and also the tension spring works in accordance with the increasing load, the deflection can also be sufficiently felt, and the bottom-touching feeling is avoided, thus providing a better feeling.

BRIEF DESCRIPTION OF THE DRAWINGS

These and other objects and features of the present invention will become apparent from the following description of the preferred embodiments thereof taken in conjunction with the accompanying drawings, in which.

DETAILED DESCRIPTION OF THE INVENTION

Figure 1:
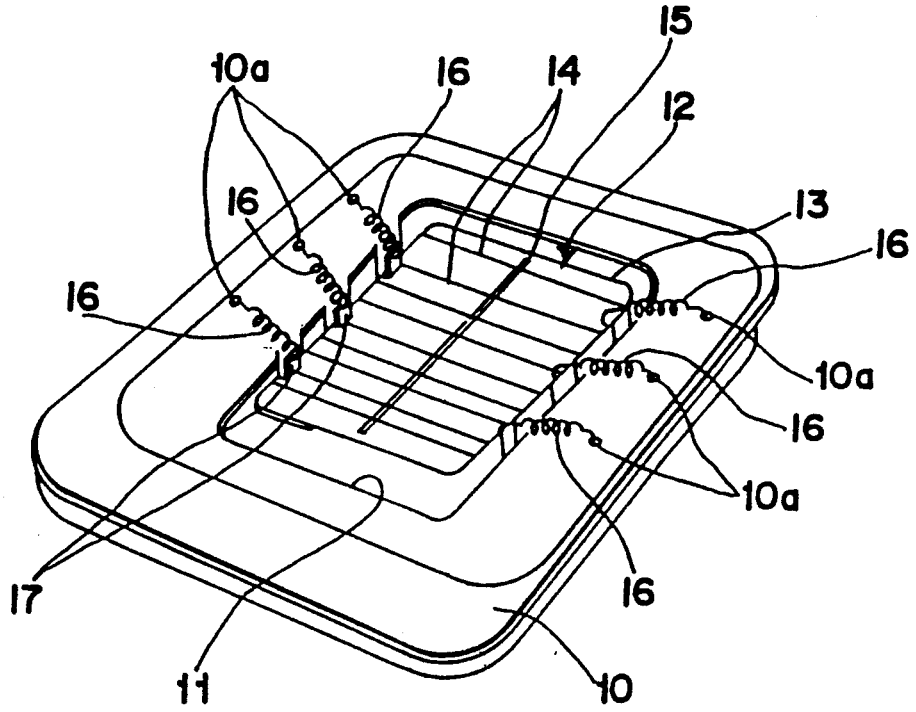
FIG. 1 is a perspective view of the cushion construction of a first embodiment in accordance with the present invention.

Before the description of the present invention proceeds, it is to be noted that like parts are designated by like reference numerals throughout the accompanying drawings.

First Embodiment

Figure 2:
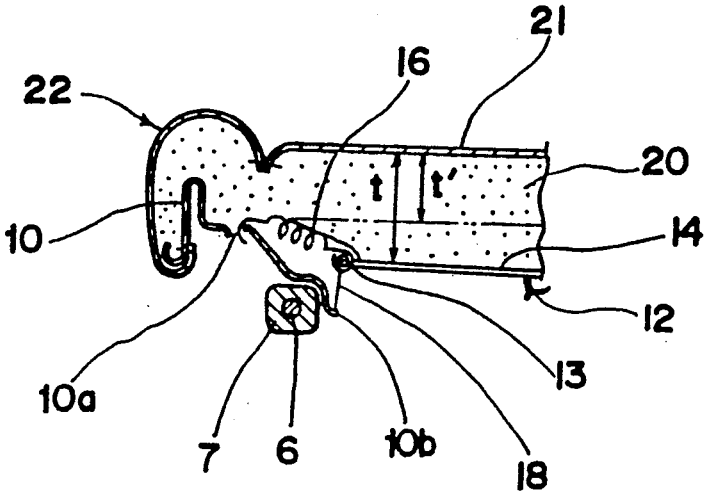
FIG. 2 is a sectional view of the essential portions of FIG. 1.

Referring now to the drawings, there is shown in FIGS. 1 and 2 a cushion frame 10 of a seat cushion 22 according to this embodiment of the present invention, which is formed in a square frame and has a square-shaped central opening 11 in the central portion thereof.

A square-shaped mesh frame 12 is disposed within the central opening 11 of the cushion frame 10.

The mesh frame 12 is composed of a square-shaped frame wire 13, side cords 14, stretched in the width direction at given intervals in the longitudinal direction of the frame wire 13, a center cord 15 provided in the longitudinal direction of the frame wire 13 so as to retain the interval of each side cord 14, with the frame wire 13 being formed of a core having a thin paper layer wound on the surface of the core, the center cord 15 also being formed of the core with the thin paper layer therearound.

Small engagement holes **10*a* are drilled at given intervals in the longitudinal direction on both sides in the width direction of the cushion frame 10, with one end portion of each tension spring 16 being engaged in a corresponding small hole 10*a*, and the other end portion of the tension spring 16 being respectively engaged with the frame wire 13 of the mesh frame 12**.

The tension spring 16 is tensioned to an extent where only a tensile force elastic enough to stretch it and support the mesh frame 12 in the horizontal condition acts when no one is seated or the engagement of the components during assembly is effected.

Figure 19:
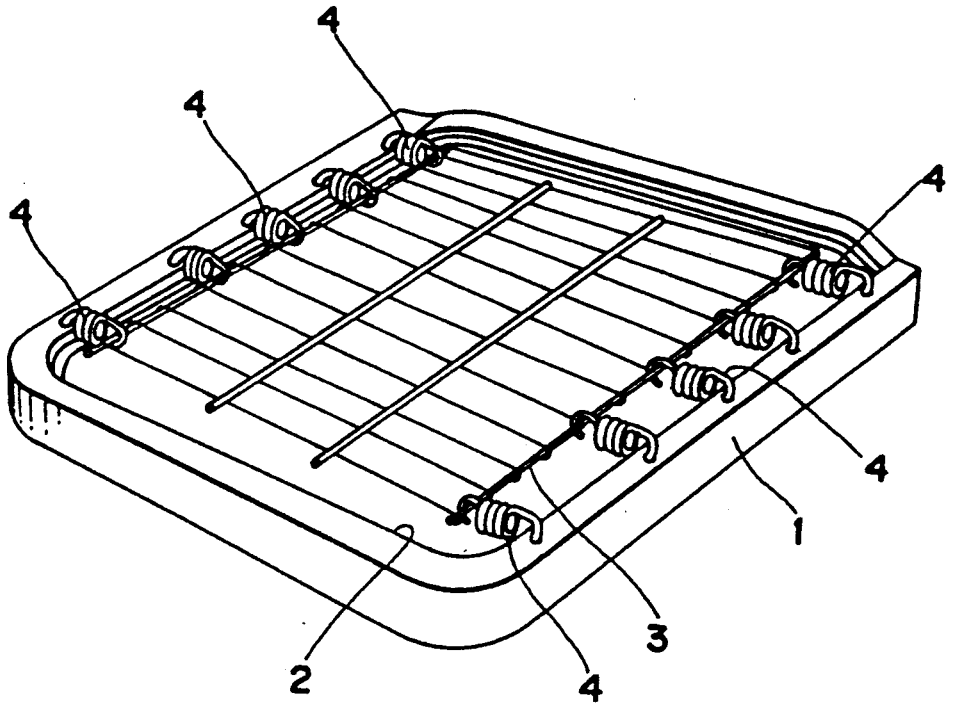
Fig. 19 PRIOR ART
FIG. 19 is a perspective view of the conventional cushion construction.
Figure 20:
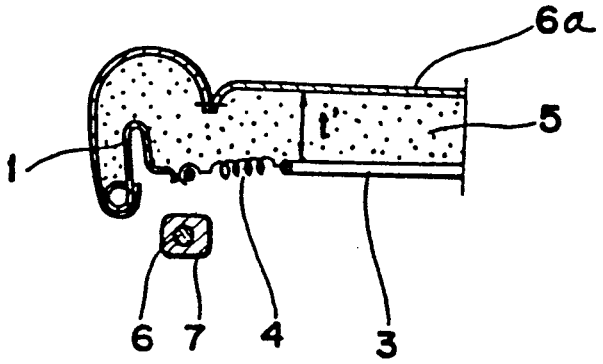
Fig. 20 PRIOR ART
FIG. 20 is a sectional view of the essential portions of the cushion construction of FIG. 19.

Accordingly, to this extent the construction is the same as the conventional construction shown in FIG. 19.

Projecting portions **10*b* which project downwardly so as to extend under the frame wire 13 of the mesh frame 12, avoiding a slide screw 6, a slide nut 7, and so on, are formed at proper locations on the peripheral edge of the central opening 11 of the cushion frame 10, with a hook hole 10*c* (see FIG. 3) being drilled in each projecting portion 10*b***.

Figure 3:
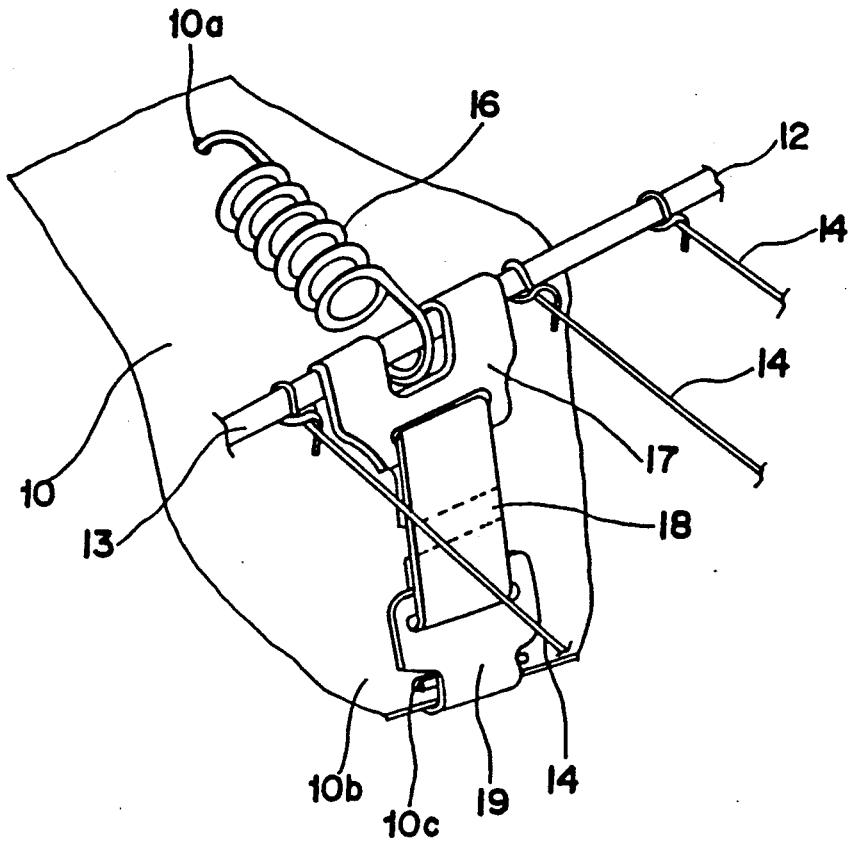
FIG. 3 is an enlarged perspective view of the essential portions of FIG. 1.

A first hook metal fitting 17 is bent around and mounted on the frame wire 13 of the mesh frame 12 as shown in FIG. 3, one corresponding to each tension spring 16, with a second hook metal fitting 19 being connected by a tension band 18 to each first hook metal fitting 17, the second metal fitting 19 being engaged in a corresponding hook hole **10*c* of the cushion frame 10**.

In the above-described construction, as the tension spring 16 has only to be engaged between the cushion frame 10 and the mesh frame 12 with a force elastic enough to stretch and support the mesh frame 12 during the assembly operation, the engagement operation is easier to effect.

Because the engagement of the second hook metal fitting 19 into the hook hole **10*c* of the projecting portion of the cushion frame 10 with the mesh frame 12 is controlled from above, the engagement operation of the tension band 18** is also simplified.

When the tension band 18 is engaged, the mesh frame 12 is downwardly pulled and the tension spring 16 is retained with the tension spring being obliquely stretch downwardly.

Thereafter, a cushion pad 20 is placed on the mesh frame 12 and the cushion frame 10, and the surface of the cushion pad 20 is covered with a trim 21 so as to complete the seat cushion 22.

The mesh frame 12 is lowered when the tension spring 16 has been made oblique, thus allowing the thickness 5 of the cushion pad 20 to be made larger than the conventional thickness t' so as to improve the cushioning property.

The initial deflection of the cushion is good because the thickness of the cushion pad 20 is larger, and the elastic force (tensile force) works in advance upon the tension spring 16. The tension spring 16 works in accordance with the larger load of the sitter, so that the sitter may feel the deflection sufficiently, and feel better without a bottom-touching feeling.

Figure 4:
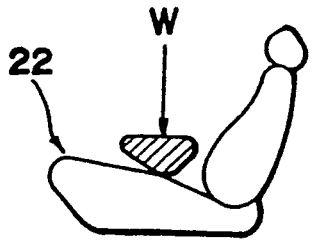
FIG. 4 is a view for illustrating a procedure of a load experiment.
Figure 5:
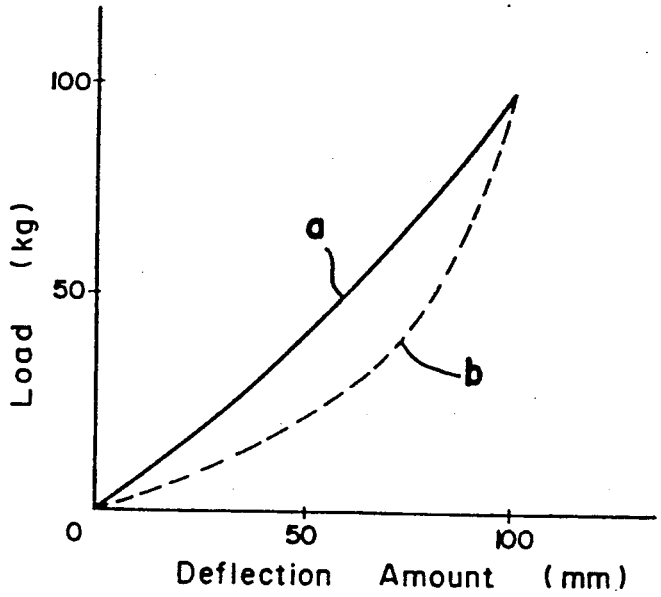
FIG. 5 is a graph showing the relationship between the load and the deflection amount.

FIG. 4 diagrammatically shows an experiment, wherein a 100 kg load W is applied to the seat cushion 22. As shown in FIG. 5, in the conventional cushion, as shown with a broken line b, the deflection amount is increased rapidly and then decreased as the load W of the sitter becomes larger, causing the bottom-touching feeling. In the present invention, as shown with a solid line a, the deflection amount is increased almost constantly as the load of the sitter becomes larger, so that the bottom-touching feeling is avoided.

Figure 6:
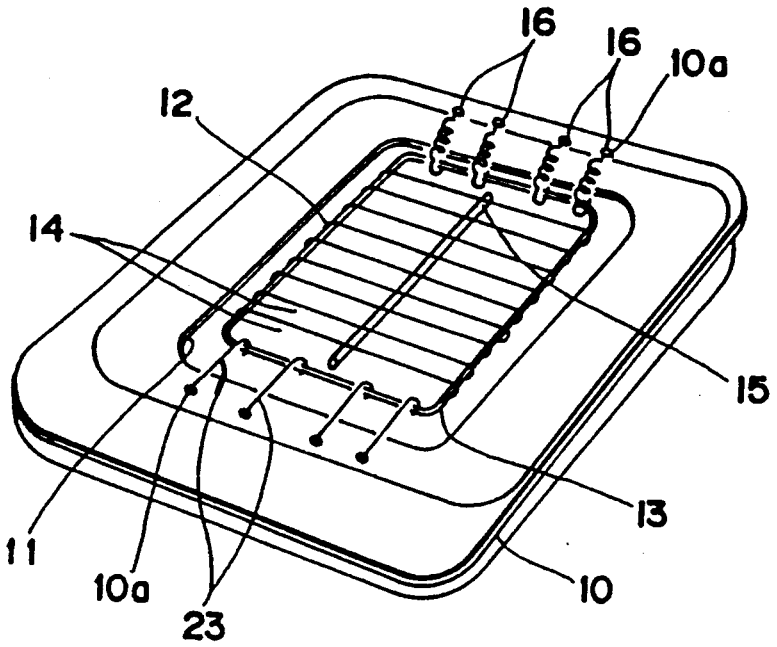
FIG. 6 is a perspective view of the cushion construction according to a different embodiment.
Figure 7:
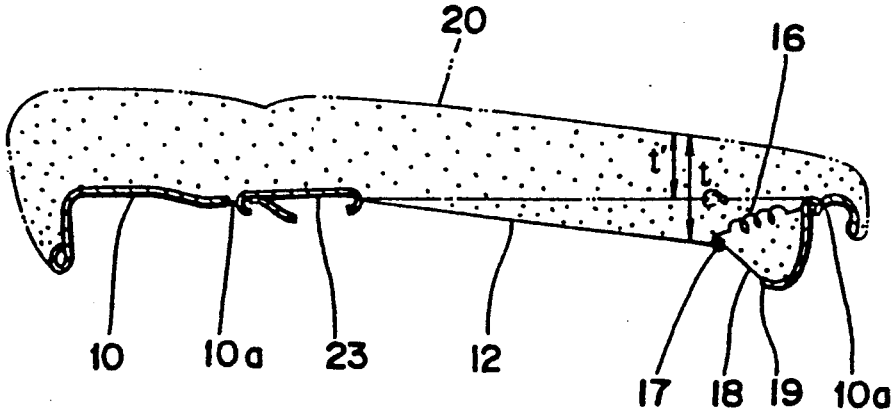
FIG. 7 is a sectional view of FIG. 6.

In the above-described embodiment, the tension spring 16 is stretched in the width direction (lateral stretching). The tension spring may be stretched in the longitudinal direction (longitudinal stretching) as shown in FIGS. 6 and 7. In this case, the small engagement holes 10*a* are drilled on both ends in the longitudinal direction of the cushion frame 10. One end of each of hooks 23 is engaged in the small engagement holes 10*a* on the front end, with the other ends of hooks 23 being engaged with the front end portion of the frame wire 13 of the mesh frame 12. One end portion of each of the tension springs 16 is engaged in the small engagement hole 10*a* on the rear end, with the other end portion of each tension spring 16 being engaged with the rear end portion of the frame wire 13 of the mesh frame 12.

The first hook metal fitting 17 of each tension band 18 is mounted on the rear end portion of the frame wire of the mesh frame 12. The second hook metal fitting 19 is engaged in a hook hole 10*c* of the projecting portion of the cushion frame 10. Thus, the rear portion of the mesh frame 12 is downwardly pulled, with the tension springs 16 being retained in a condition where the tension spring 16 is downwardly pulled obliquely.

The rear portion of the cushion pad 20, i.e. the portion upon which the load of the sitter is applied, can have an increased thickness t.

Second Embodiment

Figure 8:
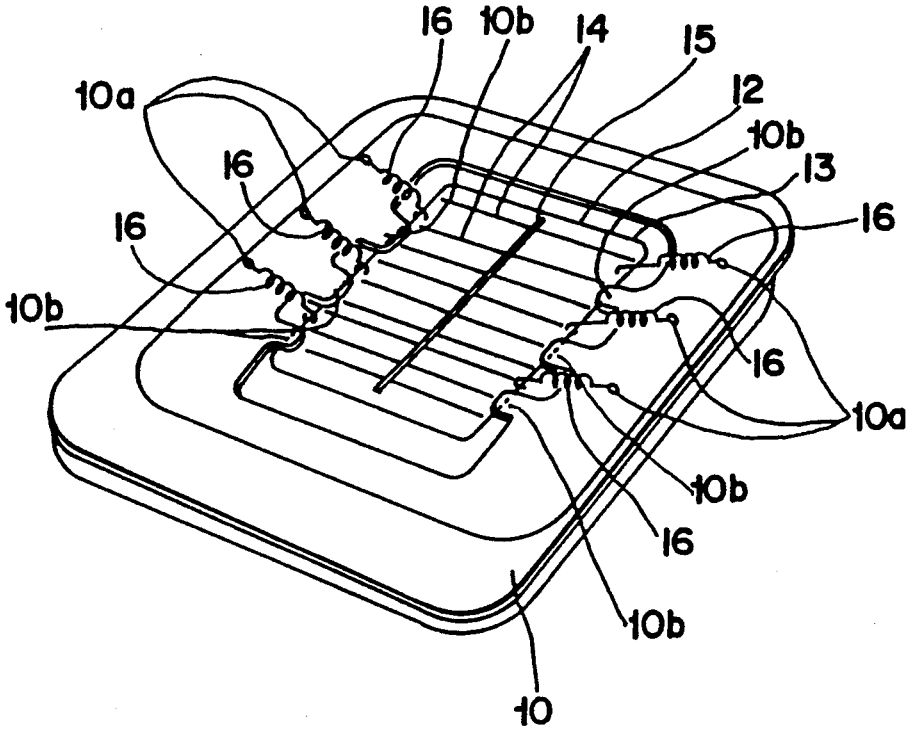
FIG. 8 is an enlarged perspective view of the cushion construction according to a second embodiment of the present invention.
Figure 9:
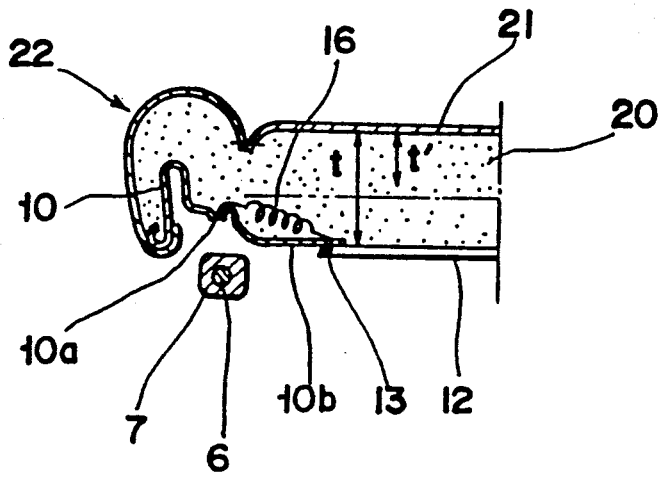
FIG. 9 is a section view of the essential portions of FIG. 8.

A seat cushion of a second embodiment shown in FIGS. 8–10 will be described only to the extent that it differs from the first embodiment, with the same parts as those in the first embodiment being designated by the same reference numerals.

Figure 10:
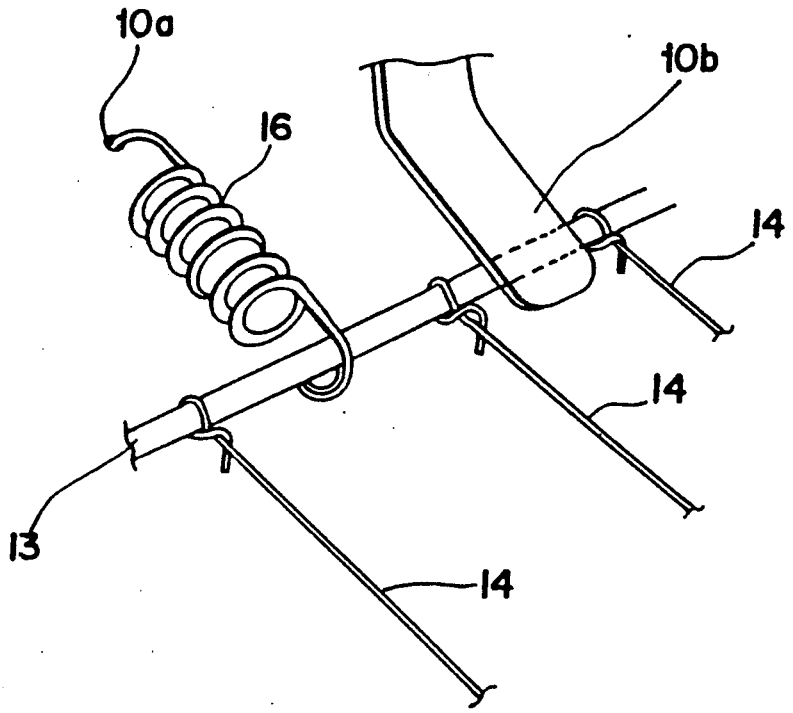
FIG. 10 is an enlarged perspective view of the essential portions of FIG. 8.

In the seat cushion of the second embodiment, the projecting portions 10*b* extend downwardly and then laterally over the side of the frame wire 13 of the mesh frame 12 and are formed in proper locations on the peripheral edge of the central opening of the cushion frame 10 (see FIG. 10).

In the above-described construction, the tension spring 16 has only to be engaged between the cushion frame 10 and the mesh frame 12 with a force elastic enough to stretch and support the mesh frame 12 during the assembly operation of the components, and the engagement operation becomes easier to effect.

Then, the mesh frame 12 is controlled from an upper, oblique position while being moved in the width direction. The frame wire 13 is engaged under the projecting portion 10*b* of the cushion frame 10 so that the frame wire 13 is engaged against the bottom of the projecting portion 10*b*.

Accordingly, the mesh frame 12 is pulled downwardly, and the tension spring 16 is retained with the tension spring 16 being downwardly stretched obliquely.

The cushion pad 20 is placed on the mesh frame 12 and the cushion frame 10, and the trim 21 is covered over the surface of the cushion pad 20, thus completing the seat cushion 22.

The mesh frame 12 thus can be lowered after the tension spring 16 has been made oblique. As the thickness t of the cushion pad 20 can be made larger than the conventional thickness t', the cushioning property can be improved.

Also, as the thickness of the cushion pad 20 is large, the initial deflection of the cushion is good. As the elastic force (tensile force) works in advance upon the tension spring 16, the tension spring 16 works in accordance with the larger load of the sitter. The sitter may feel the deflection sufficiently, so that the bottom-touching feeling is avoided so as to improve the feeling.

As a thin sheet of paper is wound on the frame wire 13, metallic contact sounds are not caused if the frame wire is engaged against the projecting portion 10*b* of the cushion frame 10.

An experiment wherein a load W of 100 kg was placed upon the seat cushion 22, showed that this embodiment has the same characteristics as those shown in FIG. 5. As shown in FIG. 5, in the conventional seat cushion, as shown by the broken line b, the deflection amount is increased rapidly and then decreased as the load W of the sitter becomes larger so as to cause the bottom-touching feeling. In the present invention, as shown by the solid line a, the deflection amount is increased almost constantly as the load of the sitter becomes larger, so that the bottom-touching feeling is avoided.

Figure 11:
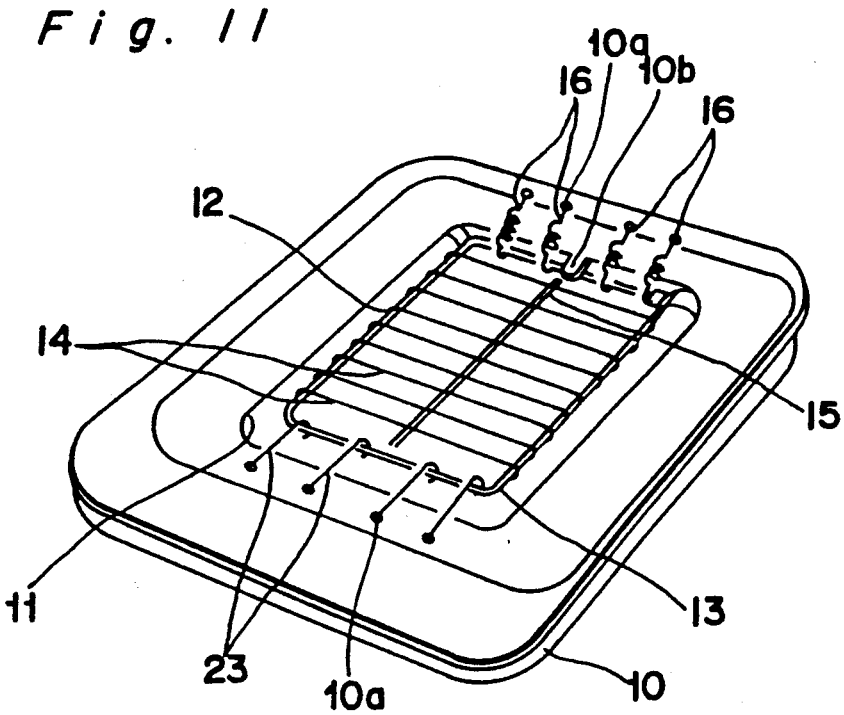
FIG. 11 is a perspective view of the cushion construction of a different embodiment.
Figure 12:
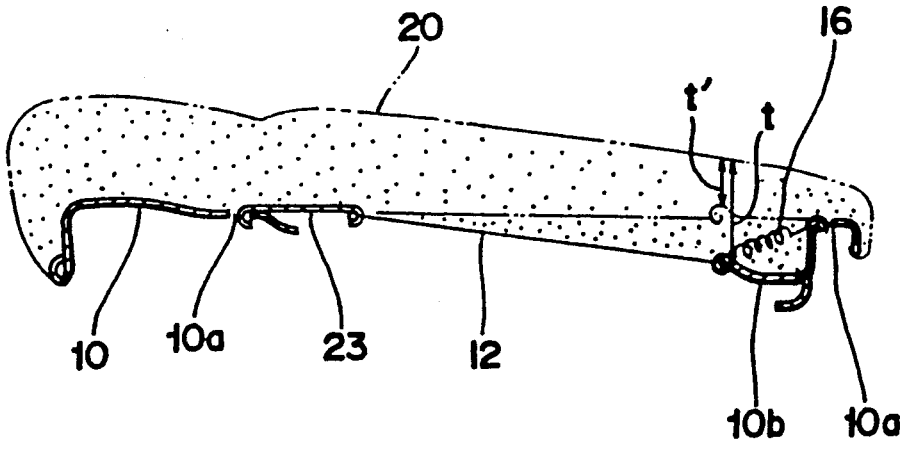
FIG. 12 is a sectional view of FIG. 11.
Figure 13:
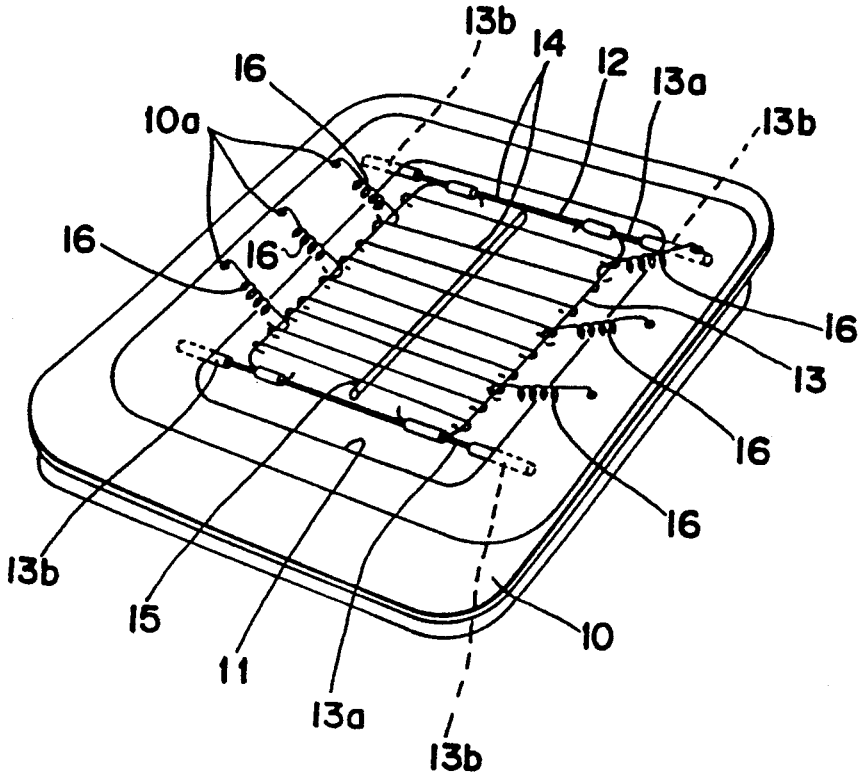
FIG. 13 is a perspective view of a third embodiment of the cushion construction of the present invention.
Figure 14:
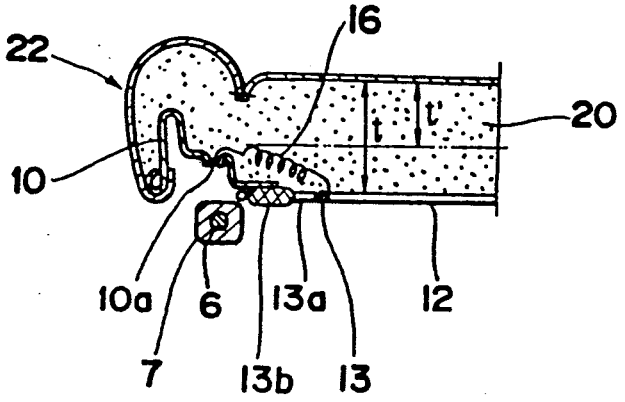
FIG. 14 is a sectional view of the essential portions of FIG. 13.

In the above-described embodiment, although the tension spring 16 was stretched in the width direction, the tension spring may be stretched in the longitudinal direction as show in FIGS. 11 and 12. In this case, the small engagement holes 10*a* are drilled on both ends in the longitudinal direction of the cushion frame 10. The hooks 23 are engaged in engagement holes 10*a* on the front end and with the front end portion of the frame wire 13 of the mesh frame 12. One end portion of the tension springs 16 is engaged in the engagement holes 10*a* on the rear end and the other end portion of tension springs 16 is engaged with the rear end portion of the frame wire 13 of the mesh frame 12.

Projecting portions 10*b* are formed on the rear portion of the cushion frame 10, and the rear end portion of the frame wire of the mesh frame 12 is engaged under the projecting portions 10*b* so as to be held against the projecting portions 10*b*. The rear portion of the mesh frame 12 is lowered downwardly so as to retain the tension springs 16 in a condition where the tension springs are downwardly stretched.

Therefore, the rear portion of the cushion pad 20, i.e. the portion upon which the load of the hip portion of the sitter acts, can be increased in thickness t.

Third Embodiment

A seat cushion in a third embodiment shown in FIGS. 13–16 will be described only to the extent that it differs from the previously described embodiments, with the same parts as those of the first embodiment being designated by the same reference numerals.

In the seat cushion of the third embodiment, the projecting portions 10*b*, which extend downwardly are formed on the peripheral edge of the central opening 11 of the cushion frame 10.

Figure 16:
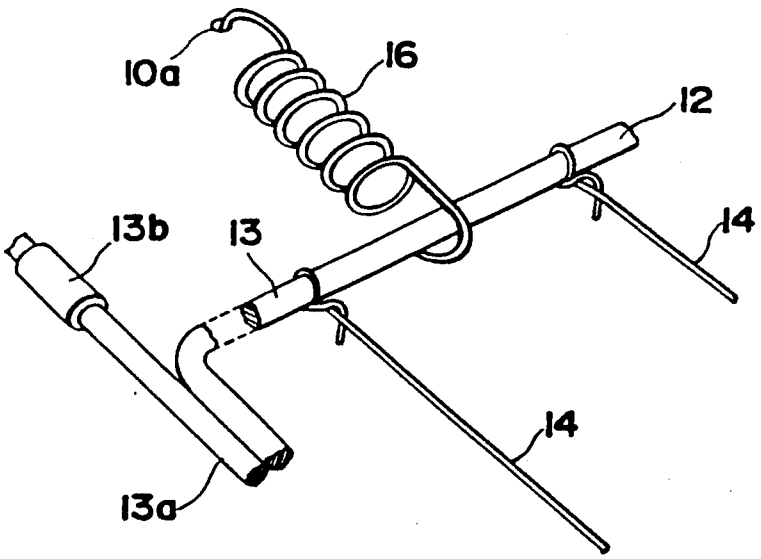
FIG. 16 is an enlarged perspective view of the essential portions in a modified embodiment of a projecting portion.

As shown in FIG. 16, portions (projection wires) 13*a*, which extend outwardly of the mesh frame in the width direction from the frame wire 13, are provided at the front end portion and the rear end portion of the frame wire 13 of the mesh frame 12, and silencers 13*b* are mounted on the free ends of the respective projection portions 13*a*.

Figure 15:
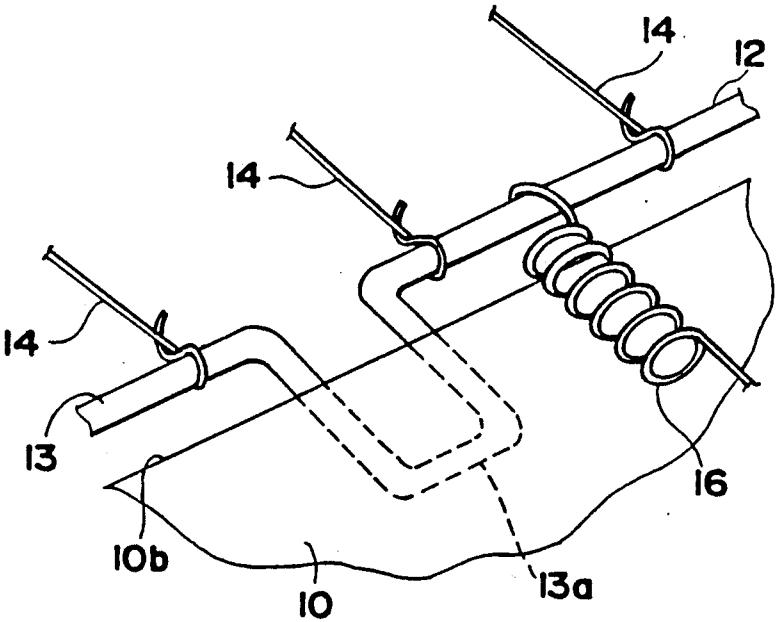
FIG. 15 is an enlarged perspective view of the essential portions of FIG. 13.

As shown in FIG. 15, a projection portion 13*a* may be integrally formed with the frame wire 13, projecting convexly from the intermediate portion of a longitudinal side portion of the frame wire 13.

In the above-described construction, as the tension spring 16 has only to be engaged between the cushion frame 10 and the mesh frame 12 with the force elastic enough to stretch and support the mesh frame 12 during the assembly of the components, the engagement operation is easier to effect The mesh frame 12 is controlled from an upper oblique direction, while being moved in the width direction. The silencer 13*b* of the projection portion 13*a* of the frame wire 13 is engaged under a corresponding projecting portion 10*b* of the cushion frame 10, with the silencer 13*b* being against the projecting portion 10*b*.

Thus, the mesh frame 12 is lowered, and the tension spring 16 is retained while being obliquely stretched downwardly.

Thereafter, the cushion pad 20 is placed on the mesh frame 12 and the cushion frame 10, and the surface of the cushion pad 20 is covered with a trim 21 so as to complete the seat cushion 22.

As the tension spring 16 is oblique, the mesh frame 12 is lower than in the conventional structure. Therefore, because the thickness t of the cushion pad 20 may be made larger, the cushioning property is improved.

Because the thickness of the cushion pad 20 is great, the initial deflection of the cushion is good. Because the elastic force works in advance upon the tension spring 16, the tension spring 16 works in accordance with the larger load of the sitter. The sitter may feel the deflection sufficiently, and there is no bottom-touching feeling so that the feeling of the seat is improved.

Because the silencer 13*b* of the projection portion 13*a* is against the projecting portion 10*b* of the cushion frame 10, no metal contact sounds are caused.

An experiment, wherein the load W of 100 kg was placed upon the seat cushion 22, showed that the structure of this embodiment has the same characteristics as those of FIG. 5. As shown in FIG. 5, in the conventional seat cushion, as shown by broken line b, the deflection amount is increased rapidly and then decreased as the load W of the sitter becomes larger so as to cause the bottom-touching feeling. In the present invention, as shown by solid line a, the deflection amount is increased almost constantly as the load of the sitter becomes larger so that the bottom-touching feeling is avoided.

Figure 17:
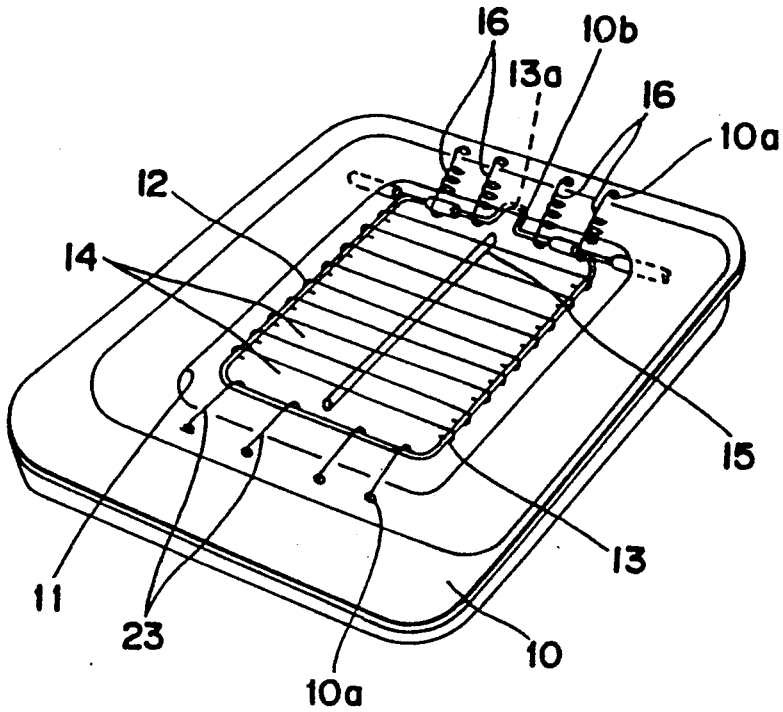
FIG. 17 is a perspective view of the cushion construction of a different embodiment.
Figure 18:
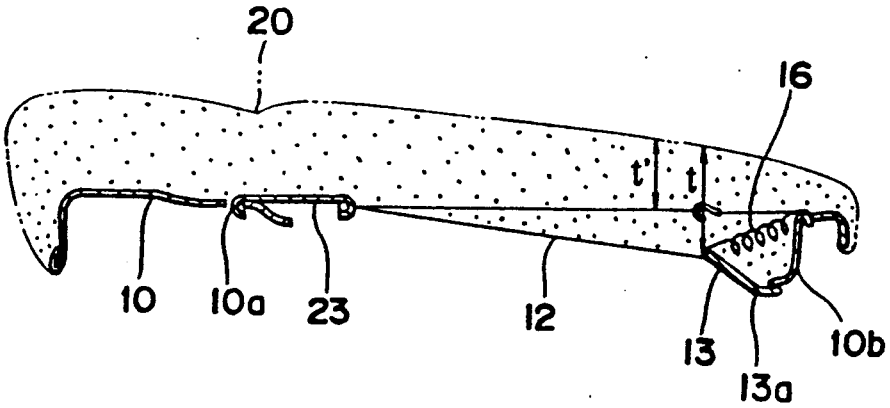
FIG. 18 is a sectional view of FIG. 17.

In the above-described embodiment, the tension spring 16 was stretched in the width direction. As shown in FIGS. 17 and 18, stretching in the longitudinal direction can be effected. In this case, the small engagement holes 10*a* are drilled on both ends in the longitudinal direction of the cushion frame 10. The hooks 23 are engaged in the engagement holes 10*a* on the front end and with the front end portion of the frame wire 13 of the mesh frame 12. One end portion of each tension spring 16 is engaged in a small engagement hole 10*a* on the rear end and the other end portion of the tension spring 16 is hooked to the rear end portion of the frame wire 13 of the mesh frame 12.

Projection portions 13*a* are formed on the rear end portion of the frame wire 13 of the mesh frame 12, and the projection portions 13*a* are engaged under the projecting portion 10*a* of the cushion frame 10 against the projecting portion 10*b*. The rear portion of the mesh frame 12 is thereby lowered, with the tension spring 16 being retained in a condition obliquely stretched downwardly.

The rear portion of the cushion pad 20, i.e. the portion upon which the load of the hip portion of the sitter is applied, can be given a larger thickness t.

Although the present invention has been fully described by way of example with reference to the accompanying drawings, it is to be noted here that various changes and modifications will be apparent to those skilled in the art. Therefore, unless such changes and modifications depart from the scope of the present invention, they should be construed as included therein.

What is claimed is:

1. A seat cushion construction, comprising:

a cushion frame having a central opening and longitudinal and lateral sides and an inner peripheral edge;

a mesh frame disposed within the central opening of said cushion frame;

a plurality of elongatable tension springs connected between said cushion frame and said mesh frame and supporting said mesh frame in the central opening of said cushion frame;

a cushion pad on said mesh frame and said cushion frame and a trim material covering the upper surface of said cushion;

projecting portions on said inner peripheral edge along at least one side of said cushion frame and extending downwardly and inwardly into said central opening below the level of the bottom of said cushion frame and having free ends thereon within said central opening; and said mesh frame being engaged under the free ends of said projecting portions for, when there is no load on said cushion pad, being held in a lowered position in said central opening below the level of the bottom of said cushion frame with said elongatable tension springs stretched and extending obliquely downwardly from said cushion frame.

2. A seat cushion as claimed in claim 1 in which said projecting portions are along both longitudinal sides of said cushion frame.

3. A seat cushion as claimed in claim 1 in which said projecting portions are along only a rear lateral side of said cushion frame.

4. A seat cushion as claimed in claim 1 in which said mesh frame has projection portions thereon and the projection portions are engaged under the free ends of said projecting portions for holding said mesh frame in said lowered position.

5. A seat cushion as claimed in claim 4 in which said projecting portions are along both longitudinal sides of said cushion frame.

6. A seat cushion as claimed in claim 4 in which said projecting portions are along only a rear lateral side of said cushion frame.

* * * * *